United States Patent [19]

Carver et al.

[11] Patent Number: 4,866,791

[45] Date of Patent: Sep. 19, 1989

[54] WOMAN'S CONVERTIBLE SHIRT

[76] Inventors: Barbara Carver, 85 E. End Ave., New York, N.Y. 10028; Donald Spector, 380 Mountain Rd., Union City, N.J. 07087

[21] Appl. No.: 184,442

[22] Filed: Apr. 21, 1988

[51] Int. Cl.[4] ..... A41B 1/00; A41D 1/18

[52] U.S. Cl. ..... 2/106; 2/113

[58] Field of Search ..... 2/106, 109, 113, 114

[56] References Cited

U.S. PATENT DOCUMENTS

| | | | |
|---|---|---|---|
| 1,130,216 | 3/1915 | Thayer | 2/113 X |
| 1,414,206 | 4/1922 | Redmond | 2/113 |
| 1,662,326 | 3/1928 | Page | 2/109 |
| 2,575,791 | 11/1951 | Brown | 2/106 |
| 2,603,788 | 7/1952 | Page | 2/106 X |
| 2,670,472 | 3/1954 | Kelley | 2/113 |
| 3,296,627 | 1/1967 | Beard et al. | 2/113 |
| 3,449,765 | 6/1969 | Beard et al. | 2/113 |

FOREIGN PATENT DOCUMENTS

| | | | |
|---|---|---|---|
| 1250962 | 12/1960 | France | 2/88 |

*Primary Examiner*—Werner H. Schroeder
*Assistant Examiner*—Jeanette E. Chapman

[57] ABSTRACT

A woman's sport shirt that normally functions as a waist-length T-shirt having a circular neck opening and short sleeves. The waist hem of the shirt is provided on opposite sides thereof with complementary snap buttons, or similar hand-operated connectors. When worn by a woman, the shirt is readily convertible into a halter-like garment by raising the waist hem above the midriff, then lifting the front section of the skirt above the head and rolling it behind the neck to create a yoke joining left and right portions of the front section which are then drawn across the bust of the wearer and interconnected by the snap buttons to form a bra-like bust support above the exposed midriff.

5 Claims, 1 Drawing Sheet

WOMAN'S CONVERTIBLE SHIRT

BACKGROUND OF INVENTION

1.Field of Invention

This invention relates generally to women's sports apparel, and more particularly to a woman's sport shirt which normally has the appearance of a waist length T-shirt, the shirt, without being taken off by the wearer, being readily convertible into a halter-like garment acting to support the bust and to expose the wearer's midriff.

2. Status of Prior Art

The T-shirt is universally used as a basic garment in sports activity. In its traditional form, the T-shirt is a collarless, short-sleeved or sleeveless undershirt of waist length, or an outer shirt of similar design. T-shirts intended for sports outerwear are usually made of moisture absorbent, woven cotton fabric, although they are sometimes fabricated of mixtures of synthetic and natural fibers, or of knitted fabrics that are stretchable.

Women joggers or racers generally wear a short-sleeved T-shirt in combination with running shorts. The advantage of a T-shirt is that it is free of restraints and affords some degree of warmth as well as adequate coverage above the waist. This freedom from restraint is a mixed blessing, for many women require bust support, and a T-shirt is incapable of providing such support.

In strenuous sports activity, a woman may become overheated; and while a male jogger or racer in similar circumstances may simply take off his T-shirt and continue his activity naked above the waist, it is normally not possible for a woman to do so.

A similar situation may arise when a woman wears a T-shirt on a beach under a hot sun, for she cannot, in order to be cooler, simply remove her T-shirt. And should a woman on the beach who is wearing shorts suitable for swimming, then wish to take a swim, a T-shirt is inappropriate for this purpose in that it is a relatively loose garment which drags in the water and does not provide bust support.

On the other hand, a conventional halter, which is a woman's blouse that leaves the back, the arms and the midriff bare and is typically held in place by straps around the neck and across the back, is inherently a cooler garment than a T-shirt, it does not cause drag in water and affords some degree of bust support. Moreover, a halter is more decorative and less utilitarian in appearance than a T-shirt and is more suitable for dressier occasions.

If a woman has available in addition to shorts, a T-shirt and a halter and is in a situation where a changing room or other private facility is available, then when it is desirable to do so, she can switch from the T-shirt to the halter. However, this requires that the woman wear one of these garments and carry the other in a bag or other garment carrier. This rules out running or jogging; for in this situation, the woman must have her hand free and she cannot carry a bag. Nor is a changing facility then usually available.

The modern woman seeks to simplify her wardrobe and to carry as little as possible. Yet this woman wishes to be presentable and comfortable under changing circumstances.

SUMMARY OF INVENTION

In view of the foregoing, the main object of this invention is to provide a woman's sport shirt that when worn has the appearance of a waist-length T-shirt and which, without being taken off, is readily convertible into a halter-like garment acting to support the bust and expose the midriff.

The practical advantage of a convertible shirt in accordance with the invention is that it does away with the need for both a T-shirt and a halter, and a carry bag for one of these pieces of apparel as the other is worn. It also dispenses with the need for a changing facility, for the conversion takes place while the garment is worn.

Thus, a woman may wear the shirt in its T-shirt mode while jogging; and should she in the course of this activity find the T-shirt to be excessively warm, she can convert the shirt, in the course of jogging, to its more ventilated halter mode in which the midriff is bare.

Should the woman wear the shirt as a T-shirt in combination with shorts on the beach and wish to take a swim, there is no need for a swim suit, for she can convert the T-shirt into a halter-like upper which together with the shorts function as a drag-free swim suit.

Also, a woman may use the shirt in its T-shirt mode during the day in combination with shorts as an outfit suitable for daytime play activity, and if she also has with her a wraparound skirt that can go over the shorts, she can then don this skirt and convert the shirt into a halter, thereby creating a more dressy outfit suitable for evening wear.

Yet another object of this invention is to provide a convertible shirt whose tailoring is essentially that of a conventional T-shirt that can be inexpensively manufactured, the T-shirt being rendered convertible simply by the addition of snap buttons or other connecting elements to the waist hem of the shirt.

Briefly stated, these objects are attained in a woman's sport shirt that normally functions as a waist-length T-shirt having a circular neck opening and short sleeves. The waist hem of the shirt is provided on opposite sides thereof with complementary snap buttons, or similar hand-operated connectors. When worn by a woman, the shirt is readily convertible into a halter-like garment by raising the waist hem above the midriff, then lifting the front section of the skirt above the head and rolling it behind the neck to create a yoke joining left and right portions of the front section which are then drawn across the bust of the wearer and interconnected by the snap buttons to form a bra-like bust support above the exposed midriff.

OUTLINE OF DRAWINGS

For a better understanding of the invention as well as other objects and further features thereof, reference is made to the following detailed description to be read in conjunction with the accompanying drawings, wherein.

DESCRIPTION OF INVENTION

Figure 2:
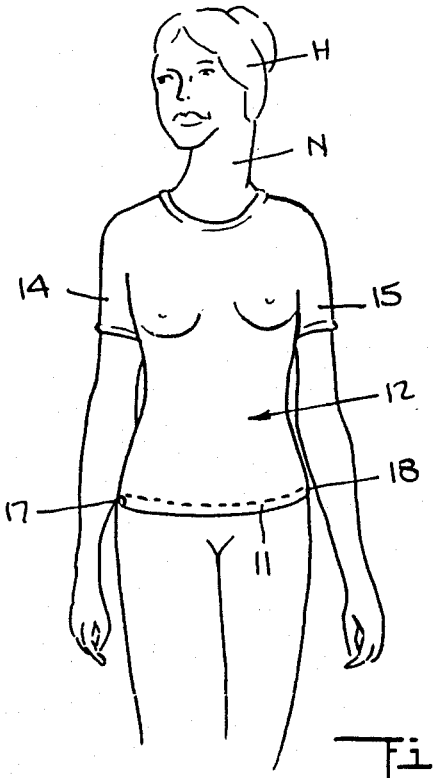
FIG. 2 shows the garment when worn by a woman in its T-shirt mode.
Figure 1:
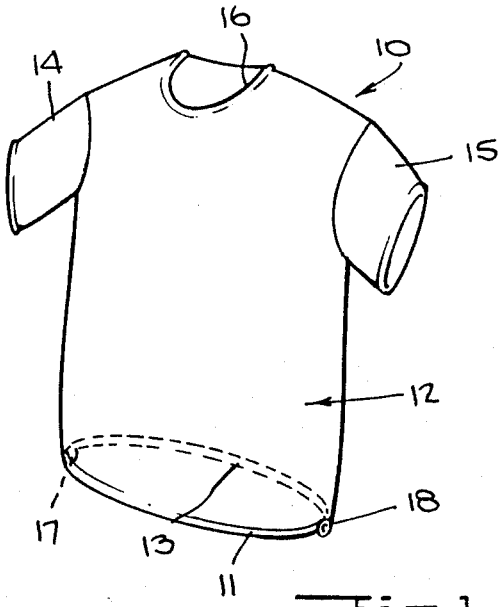
FIG. 1 is a perspective front view of a convertible woman's T-shirt garment in accordance with the invention.

Referring now to the FIGS., there is shown in front view a woman's garment or sport short 10 in accordance with the invention in its T-shirt mode, worn by a woman. Garment 10, which may be fabricated of cotton or any other suitable material, is of waist length and is provided with a waist hem 11. The garment includes a tubular body having a front section 12 and a rear section 13, short sleeves 14 and 15, and a circular neck opening 16 which surrounds the neck N of the wearer when the garment is worn in its T-shirt mode, as shown in FIG. 2.

Attached to opposite sides of waist hem 11 are the complementary male and female elements 17 and 18 of a snap button. In practice, this connector may be in hook and eye or any other clasp form, or in the form of tie strings. Thus, in the T-shirt mode, shirt 10 has the appearance of a conventional T-shirt, the only difference being the inconspicuous connector elements.

Figure 3:
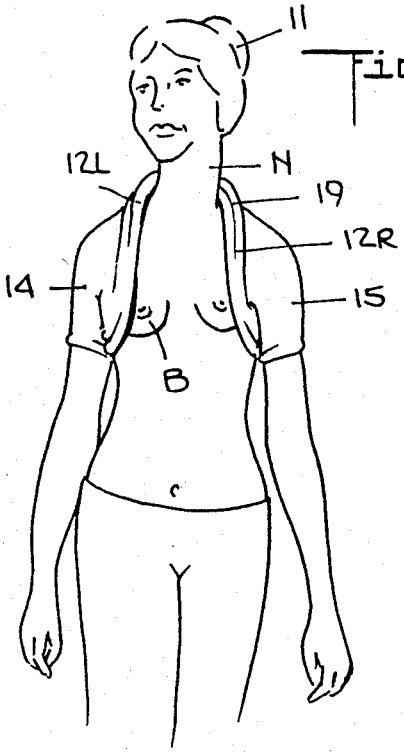
FIG. 3 shows the wearer of the garment in the process of converting it from the T-shirt to the halter-like mode.
Figure 4:
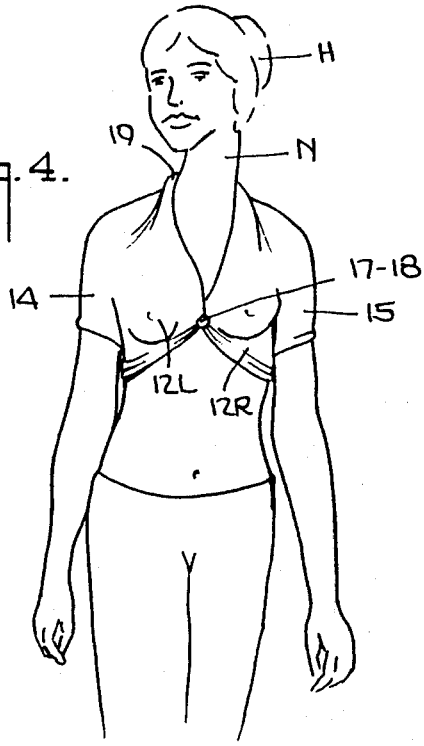
FIG. 4 shows the garment as worn in the halter-like mode.

If now, as shown in FIG. 3, the wearer of the T-shirt wishes to convert it into a halter-like mode, she raises the hem above the midriff and pulls the front section 12 over her head H and rolls it behind neck N to create a yoke 19 joined to left and right portions 12L and 12R of the front sections. These portions are then drawn across the bust B of the wearer and are interconnected by snap button 17–18 to create a bra-like covering for the bust, as shown in FIG. 4.

Thus, in the halter-like mode, bust support is provided; and because the midriff is now bare as well as the breast cleavage, the resultant garment is cooler than when in the T-shirt mode. To restore the garment to its T-shirt mode, the snap button is released, and the wearer than pulls the front section now overlying the rear section back over the head to its normal frontal position on the wearer, thereby resuming the T-shirt form of the shirt. The nature of the fabric must be such that it has sufficient stretch to permit this conversion without permanent deformation of the fabric. Thus, a shirt fabricated of spandex fibers may be desired.

Because this conversion or reconversion is readily carried out, the wearer may in the course of a sports activity or on any other occasion when one mode is better suited to this occasion than the other, switch from one mode to the other.

While there has been shown and described a preferred embodiment of a woman's convertible shirt in accordance with the invention, it will be appreciated that many changes and modifications may be made therein without, however, departing from the essential spirit thereof.

We claim:

1. A convertible women's sport shirt comprising a waist-length T-shirt configuration having a circular neck opening, a tubular body having a front and rear section, and a waist hem at the bottom of the tubular body provided at opposite sides thereof with complimentary connectors, said shirt being formed of a fabric material having sufficient stretch to permit conversion thereof without permanent deformation of the material, whereby when worn by a woman, the shirt is readily convertible by the wearer thereof into a halter-like garment by raising the waist hem above the midriff, then lifting the front section of the shirt above the head and rolling it behind the neck to create a yoke joining left and right portions of the front section which are then drawn across the bust of the wearer and interconnected by the complementary connectors to form a bra-like bust support above the exposed midriff.

2. A sport shirt as set forth in claim 1, wherein said fabric is woven cotton.

3. A sport shirt as set forth in claim 1, wherein said fabric is of a knitted material.

4. A sport shirt as set forth in claim 1, wherein said fabric is a composite of natural and synthetic fibers.

5. A sport shirt as set forth in claim 1, wherein said connectors are the male and female elements of a snap button.

* * * * *

UNITED STATES PATENT AND TRADEMARK OFFICE

CERTIFICATE OF CORRECTION

PATENT NO. : 4,866,791

DATED : September 19, 1989

INVENTOR(S) : Barbara Carver et al.

It is certified that error appears in the above-identified patent and that said Letters Patent is hereby corrected as shown below:

Column 4, line 16, after "waist-length" insert --shirt in a--

Signed and Sealed this

Twenty-eighth Day of August, 1990

*Attest:*

HARRY F. MANBECK, JR.

*Attesting Officer*

*Commissioner of Patents and Trademarks*